United States Patent [19]

Focke

[11] 4,222,485

[45] Sep. 16, 1980

[54] ONE-PIECE CONTAINER HAVING AN INTEGRAL HANDLE

[76] Inventor: Heinz Focke, 309 Verden Moorstrasse, Fed. Rep. of Germany

[21] Appl. No.: 634,100

[22] Filed: Nov. 21, 1975

Related U.S. Application Data

[63] Continuation-in-part of Ser. No. 390,263, Aug. 21, 1973, Pat. No. 3,937,391, which is a continuation-in-part of Ser. No. 83,581, Oct. 23, 1970, abandoned.

[30] Foreign Application Priority Data

Oct. 23, 1969 [DE] Fed. Rep. of Germany ..... 1953350

[51] Int. Cl.[3] ..... B65D 71/00

[52] U.S. Cl. ..... 206/141; 206/162; 206/613; 229/52 B; 229/DIG. 6

[58] Field of Search ..... 206/141, 162, 192; 229/51 DB, 51 TS, 51 AS, 52 B, 52 BC, 68 C, 54 R, 53, DIG. 6

[56] References Cited

U.S. PATENT DOCUMENTS

| | | | |
|---|---|---|---|
| 2,662,684 | 12/1953 | Robins | 229/52 B |
| 2,842,304 | 7/1958 | Ringler | 229/52 B |
| 2,918,206 | 12/1959 | Kleingers, Jr. | 229/52 B |
| 3,078,032 | 2/1963 | Robinson et al. | 229/52 B |
| 3,094,268 | 6/1963 | Swanson et al. | 229/52 B |
| 3,123,277 | 3/1964 | Menzies | 229/51 TS |
| 3,353,709 | 11/1967 | Lawrence | 206/141 |
| 3,356,258 | 12/1967 | Vesak | 229/51 TS X |
| 3,362,617 | 1/1968 | Gieber | 229/51 AS |
| 3,515,335 | 6/1970 | Atkinson | 229/52 B |
| 3,750,935 | 8/1973 | Akkerman | 229/51 TS X |

FOREIGN PATENT DOCUMENTS

| | | | |
|---|---|---|---|
| 689477 | 6/1964 | Canada | 229/52 B |
| 874828 | 7/1971 | Canada | 206/526 |
| 944579 | 12/1963 | United Kingdom | 229/52 B |

*Primary Examiner*—Herbet F. Ross

*Attorney, Agent, or Firm*—Sughrue, Rothwell, Mion, Zinn and Macpeak

[57] ABSTRACT

A container is provided having interior longitudinal and transverse partitions arranged between objects. The longitudinal partition is formed by two superimposed flaps which are of integral one-piece construction with two bottom walls, two side walls, a top wall and end walls. At least the top wall is provided with two spaced apart transversely extending rows of perforations to define a transverse handle. Transverse cuts are formed in spaced relation to the rows of perforations and extend part way down each side wall and the area of the top wall between each row of perforations and the adjacent cut may be removed completely or folded under the handle to reinforce the handle. Additional lines of perforations are formed to permit the removal of the remaining portions of the top wall on opposite sides of the handle along with portions of the side and end walls to obtain access to the objects in the container.

1 Claim, 6 Drawing Figures

ONE-PIECE CONTAINER HAVING AN INTEGRAL HANDLE

CROSS REFERENCE TO RELATED APPLICATIONS

This application is a Continuation-In-Part of my copending allowed application Ser. No. 390,263, filed Aug. 21, 1973, now U.S. Pat. No. 3,937,391, entitled "Cardboard Container for Bottles and the Like", which in turn was a Continuation-In-Part of application Ser. No. 83,581, filed Oct. 23, 1970, entitled "Cardboard Container for Bottles and the Like", now abandoned.

The invention relates to packages formed from foldable material such as cardboard or corrugated cardboard, for the accommodation of articles such as bottles, cans and the like, preferably in two rows, wherein a blank comprises a one-part top wall, side walls hinged on both sides thereof and a bottom wall adjoining the side walls.

The package according to the invention is primarily intended to hold bottles and cans of the same size. These articles are arranged in the package in two aligned, orderly rows. The invention relates essentially to the packaging of beer bottles and beer cans. The pack is closed on all sides.

The object of the invention is to design packages of the above-described type which, by means of simple measures, allow unhindered access to the contents of the package, i.e., to the bottles, cans, etc. The package should also be constructed in such a way that it can easily be transported, even in the filled state.

In order to achieve this purpose, the package according to the invention is characterized in that the top wall comprises at least two wall openings, more particularly, transverse perforations which are spaced apart from each other and which run across the top wall at least as far as its edge, these transverse perforations defining a carrying handle which is separate from the remaining part of the top wall and the ends of which pass over into the lateral walls.

Accordingly, the essence of the invention is the premarking or scoring of a carrying handle which extends transversely across the closed top wall and which enables the package to be easily transported and also opened. According to the possibilities provided by the invention, the carrying handle can be marked by means of transverse perforations which must be separated in order to form the carrying handle when the package is to be used. However, it is also possible to provide continuous dividing cuts or incisions in the top wall. In the preferred embodiment the actual carrying handle is defined by two transverse perforations spaced apart from one another. Adjacent to these transverse perforations on both sides are strips of material which are defined with respect to the remaining part of the top wall by means of incisions. When forming the carrying handle these strips are either removed by means of the transverse perforations or they are folded under the actual carrying handle, thus simultaneously forming a reinforcement for the handle and also rendering the lateral edges thereof safe for handling.

The above-mentioned features can be advantageously used in a package which is formed from a unitary blank consisting of a closed top wall, two side walls hinged thereto on both sides, bottom halves adjoining the side walls and edge flaps which are joined to the bottom halves and which are upwardly folded between the rows of articles so as to form a longitudinal central partition. Accordingly, this package firstly comprises a closed, one-part and single-layer top wall, in which the requisite perforations and dividing cuts or incisions can be made. Secondly, it comprises an especially stable bottom region on account of the double-walled longitudinal partition which is formed by gluing together the upwardly directed edge flaps of the bottom halves which extend between the rows of articles. The aforementioned longitudinal central partition can comprise transverse partitions of various types. However, the package can also be constructed without these transverse partitions.

Other features of the invention relate to the arrangement of perforation lines in the top wall and also in the side and end walls such that, in association with the carrying handle, the top wall can be opened so as to form foldable parts or, alternately, partial upper regions of the package can be entirely removed.

Various embodiments of the invention will be described hereinafter with reference to the accompanying drawings, wherein.

The drawings show the preferred application for the package according to the invention, notably as a container for holding bottles disposed in two rows(not shown).

Figure 1:
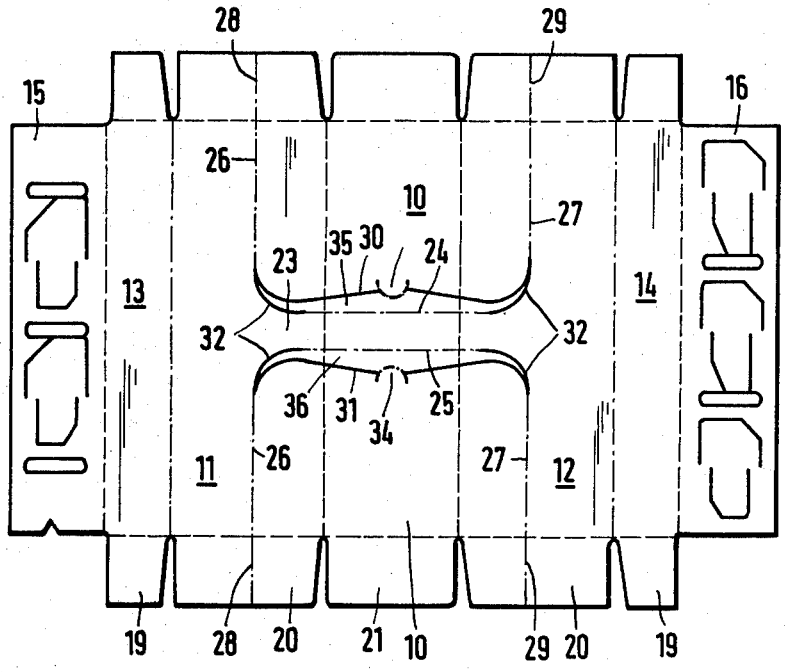
FIG. 1 shows a blank for forming a package according to the invention in the unfolded state.

The blank according to FIG. 1 consists of a plurality of zones which are marked or scored by stamping or the like, thereby making it easier to form the requisite folds. In the course thereof, zones are produced which are designed to form a top wall 10, side walls 11 and 12 adjacent to the top wall 10, more particularly, hinged thereto, and bottom halves 13 and 14 which are joined to the side walls 11 and 12. These bottom halves together produce the actual bottom wall. Edge flaps 15 and 16 are joined to the free edges of the bottom halves 13 and 14. The edge flaps 15 and 16 form a double-walled longitudinal central partition 17 in the finished package. The edge flaps 15 and 16 comprise pre-cut tabs from which transverse partitions 18 (FIG. 4) can be formed by pivoting them about 90°.

Attached to the front ends of the top wall 10, of the side walls 11 and 12 and of the bottom halves 13 and 14 are suitably dimensioned end flaps 19,20 and 21 which, in the finished package, form the end walls 22 after they have been appropriately folded together and glued.

Figure 2:
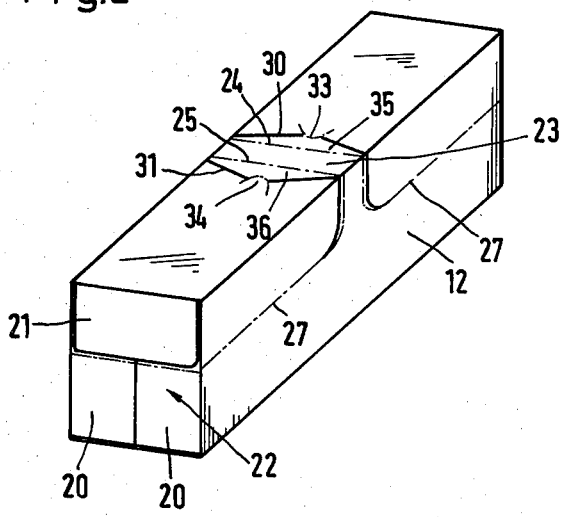
FIG. 2 is a perspective view of a pack produced from the blank shown in FIG. 1.
Figure 3:
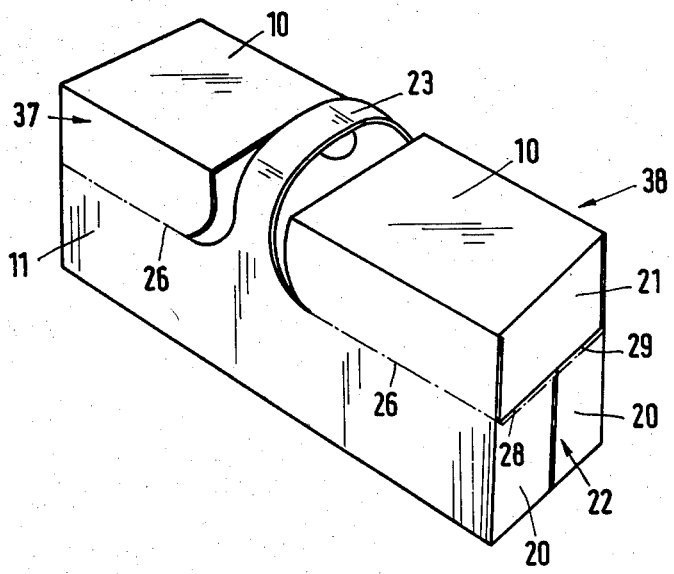
FIG. 3 is a perspective view of the package according to FIGS. 1 and 2 when in use.

A pack as shown in FIG. 2 is formed from the blank according to FIG. 1 by folding it along a plurality of lines. The package according to FIG. 2 is designed to hold two rows of bottles (or cans, etc.) and it is divided in the middle by the double-walled longitudinal partition 17 and—in the embodiment represented—by transverse partitions 18. However, it is not necessary for this package to comprise the latter. As shown, the top wall is closed, formed in one-part and of one-layer. The bottom is formed in a manner which is not important in this instance by folding the bottom halves 13 and 14 and their edge flaps 15 and 16 about a row of articles. The adjacent edge flaps 15 and 16 are then cemented together by means of adhesive so as to produce a stable container which is particularly capable of bearing weight in its bottom region.

The end walls 22 are produced by firstly folding the end flaps 20 on top of the flaps 19 and connecting them together. The end flaps 21 are then used to form a transverse connection by folding them externally against the end flaps 20 of the two package halves and connecting them thereto.

As represented in this figure, the blank and thus the finished package also comprises perforation lines and incisions in a partial region of the side walls 11 and 12. A carrying handle 23 which extends transversely across the top wall 10 and continues into the region of the side walls 11 and 12 is formed by means of these perforation lines and incisions. In the embodiment according to FIGS. 1–4, two mutually spaced and preferably parallel transverse perforations 24 and 25 are provided for this purpose approximately in the center of the package. They extend in a transverse direction across the top wall 10 and continue a good way down the side walls 11 and 12. In the present embodiment these perforations 24 and 25 are curved in the region of the side walls 11 and 12 and become the longitudinal perforations 26 and 27. The latter extend as far as the ends of the side walls 11 and 12. At this point they join with the continuation perforations 28 and 29 in the region of the end flaps 20. When the pack is in the completely folded state, the perforations 28 and 29 extend in the region of the end walls 22 directly beneath the end flaps 21.

Incisions 30 and 31 which are spaced apart from the transverse perforations 24 and 25 extend in a transverse direction in the top wall 10 and continue into the side walls 11 and 12. At this point, the incisions are curved and become the longitudinal perforations 26 and 27. In the embodiment according to FIGS. 1—4 the end regions of the transverse perforations 24 and 25 are also in the form of incisions, more particularly, the curved sections 32. This considerably facilitates handling of the closed package, as will be described in further detail hereinafter. In their center, the incisions 30 and 31 comprise perforated gripping tongues 33 and 34. When the package is closed these ensure that the top wall 10 holds together better in the region of the remaining continuous incisions 30 and 31. When the package is to be made ready for use, these gripping tongues 33 and 34 enable the carrying handle 23 to be formed.

Transverse perforations 24 and 25 and the incisions 30 and 31 define strips of material 35 and 36 on both sides of the carrying handle 23. To form the carrying handle 23, these strips 35 and 36 are either separated from the top wall 10 and the side walls 11 and 12, such that a corresponding intermediate space is produced on both sides of the carrying handle 23. Alternatively, the strips 35 and 36 can remain connected to the carrying handle 23 in the region of the transverse perforations 24 and 25 and can be folded against the underside of the carrying handle 23 in these regions (not shown). In this embodiment the strips 35 and 36 form a reinforcement which extends along the underside of the carrying handle 23. The handle 23 is also provided with rounded grippable edges.

Figure 4:
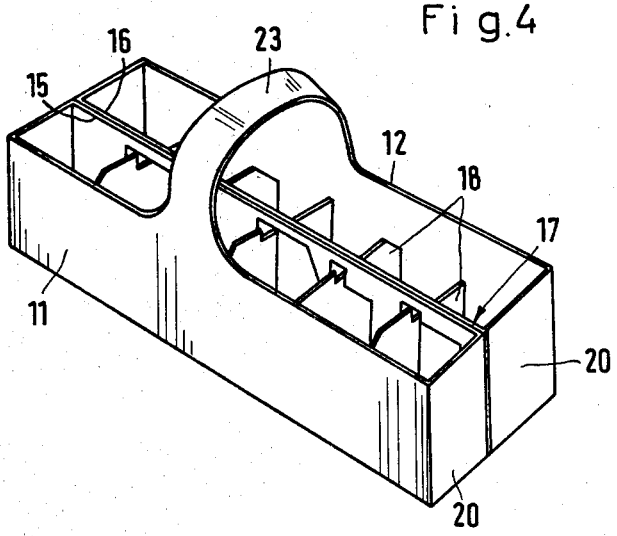
FIG. 4 is another perspective view of the package according to FIGS. 1–3 in the completely open state and including the carrying handle.

On both sides of the carrying handle 23, more particularly, adjacent to the incisions 30 and 31, end covers 37 and 38 are produced from parts of the top wall 10, the sides walls 11 and 12 and the end walls 22. After the carrying handle 23 has been formed, these end covers 37 and 38 can be torn from the remaining lower part of the package by gripping the free edge and by using the longitudinal perforations 26 and 27 and also the continuation perforations 28 and 29. As a result, the package is fully open at its upper part as represented in FIG.4 and it is also lower than the original structure. It is now easy to gain access to the bottles.

Figure 5:
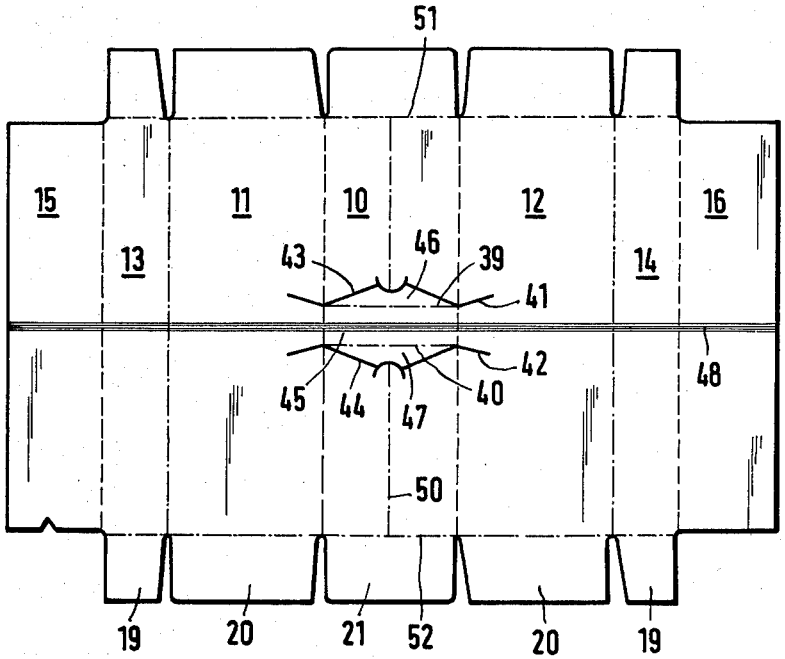
FIG. 5 is a blank of another embodiment of the package according to the invention in the unfolded state.
Figure 6:
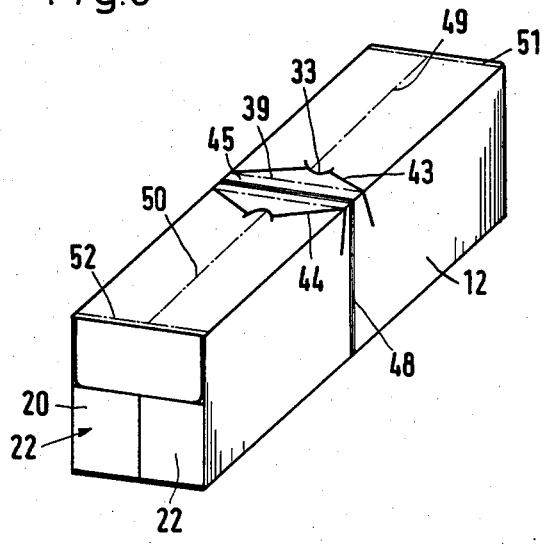
FIG. 6 is a perspective view of a package produced from the blank according to FIG. 5.

The embodiment according to FIGS. 5 and 6 differs from the above-described embodiment in that it comprises a different form of carrying handle and also the parts of the package which are designed to be opened are different. As shown in FIGS. 5 and 6, the transverse perforations 39 and 40 only extend over the width of the top wall 10. Diverging arms 41,42 of the incisions 43 and 44 are provided adjacent to the ends of the transverse perforations 39 and 40. In the region of the side walls 11 and 12 the incisions 43 and 44 mark the end sections of the carrying handle 45. Approximately triangular strips of material 46 and 47 are used to reinforce the carrying handle 45 in the manner described above by folding them against the underside of the latter.

The blank, and thus also the finished package, is provided in the region of the carrying handle 45 with a reinforcement, which, in this case, entirely surrounds the handle, i.e., covers the entire cross-section thereof. This reinforcement consists of the reinforcing strip 48. This strip can be laminated, glued or otherwise attached to the inner side or outer side of the blank. It is also possible to incorporate the reinforcing strip 48 in the layers of cardboard, corrugated cardboard, or the like. The reinforcing strip can be made of suitable material, for example, fiber-reinforced plastic, plastic strips with metal wire inserts, etc.

To enable this embodiment of the package to be opened, the top wall comprises central perforations 49 and 50 which connect at their outer ends with transversely directed end perforations 51 and 52. As a result, the perforated lines form a T-shape in each of the halves of the top wall 10. Opening flaps, which remain connected to the side walls 11 and 12, can thus be formed.

What is claimed is:

1. A container formed foldable material for the accommodation of a plurality of articles therein, said container having a top wall, side walls, end walls, bottom walls and edge flaps of integral one-piece construction, means securing said edge flaps to each other to define a longitudinally extending central partition parallel to said side walls, said top wall having two spaced apart transverse perforation line extending across the entire width of the top wall and beyond the opposite edges of the top wall part way into each side wall to define a carrying handle therebetween, longitudinally extending perforation lines in said side walls extending from the ends of each transverse perforation line toward the adjacent end of the container substantially parallel to the top wall and additional perforation lines in the end walls of the container which are continuations of said longitudinal performation lines, transverse dividing cuts spaced from said transverse perforation lines on each side of said handle which intersect the transverse perforation lines adjacent the ends thereof to define intermediate areas on each side of said handle which may be completely removed or folded under said handle along said transverse perforation lines to provide reinforcement for said handle, tongue means connecting said intermediate areas to said top wall portions across said dividing cuts intermediate the ends thereof, said tongue means having perforations so that upon separation along said perforation lines on said side and end walls and along said perforations on said tongue means on both sides of the carrying handle, end covers formed from portions of the top wall, the side walls and the end walls can be removed.

* * * * *